US008038036B2

(12) United States Patent
Bruder et al.

(10) Patent No.: US 8,038,036 B2
(45) Date of Patent: Oct. 18, 2011

(54) DISCHARGE DEVICE

(75) Inventors: Thomas Bruder, Constance (DE); Andi Herz, Eigeltingen (DE); Gerald Krampen, Radolfzell (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 735 days.

(21) Appl. No.: 12/150,559

(22) Filed: Apr. 29, 2008

(65) Prior Publication Data

US 2008/0264975 A1 Oct. 30, 2008

(30) Foreign Application Priority Data

Apr. 30, 2007 (DE) ..... 10 2007 021 415

(51) Int. Cl.
*B65D 88/54* (2006.01)

(52) U.S. Cl. ..... 222/189.09; 222/321.3; 222/321.7; 222/380

(58) Field of Classification Search ..... 222/321.3, 222/321.7, 380, 496, 402.12
See application file for complete search history.

(56) References Cited

U.S. PATENT DOCUMENTS

| | | | | |
|---|---|---|---|---|
| 3,774,849 | A | 11/1973 | Boris | |
| 4,533,068 | A * | 8/1985 | Meierhoefer | 222/189.09 |
| 4,830,284 | A | 5/1989 | Maerte | |
| 5,197,638 | A * | 3/1993 | Wood | 222/212 |
| 5,238,153 | A | 8/1993 | Castillo et al. | |
| 5,242,406 | A | 9/1993 | Gross et al. | |
| 5,429,275 | A * | 7/1995 | Katz | 222/108 |
| 5,518,377 | A | 5/1996 | Bougamont et al. | |
| 5,558,258 | A * | 9/1996 | Albini et al. | 222/496 |
| 5,636,768 | A | 6/1997 | Yamada | |
| 5,711,461 | A | 1/1998 | Foster et al. | |
| 5,752,629 | A * | 5/1998 | Hardy | 222/189.09 |
| 5,842,616 | A * | 12/1998 | Ruscitti et al. | 222/321.3 |
| 6,991,137 | B2 * | 1/2006 | Schultz | 222/377 |
| 7,131,559 | B2 * | 11/2006 | Schultz | 222/377 |
| 2007/0262090 | A1 | 11/2007 | Ritsche | |
| 2008/0093389 | A1 | 4/2008 | Vasseur et al. | |

FOREIGN PATENT DOCUMENTS

| | | | |
|---|---|---|---|
| CA | 2 179 888 | A1 | 5/1996 |
| DE | 10 2004 050 679 | A1 | 4/2006 |
| EP | 0 500 249 | A1 | 8/1992 |
| EP | 0 696 480 | A1 | 2/1996 |
| EP | 0 701 950 | A2 | 3/1996 |
| EP | 1 914 006 | A2 | 4/2008 |
| WO | WO96/13334 | A1 | 5/1996 |
| WO | WO 2006/131637 | A1 | 12/2006 |

OTHER PUBLICATIONS

Office Action of Germany Patent Office dated Feb. 13, 2008 (4 pages). European Patent Office Search Report dated May 6, 2010 (8 pages).

* cited by examiner

*Primary Examiner* — Kevin P Shaver
*Assistant Examiner* — Donnell Long
(74) *Attorney, Agent, or Firm* — Flynn, Thiel, Boutell & Tanis, P.C.

(57) ABSTRACT

The invention relates to a discharge device for discharging liquid medium, with a pump device with a variable volume pump chamber, a discharge opening for the liquid medium, a feed path between the pump device and the discharge opening, and an outlet valve which is designed to open the discharge opening as a function of the pressure in the feed path, and to a discharge head provided for this purpose. The discharge device or the discharge head has a gas-permeable and liquid-tight air outlet which connects the pump chamber or the feed path to an external environment.

13 Claims, 2 Drawing Sheets

DISCHARGE DEVICE

FIELD OF APPLICATION AND PRIOR ART

The invention relates to a discharge device for discharging liquid or pasty medium, with a pump device with a variable volume pump chamber, with a discharge opening for the liquid medium, with a feed path between the pump device and the discharge opening, and with an outlet valve which is designed to open the discharge opening as a function of the pressure in the feed path.

The invention furthermore relates to a discharge head for a discharge device, with a discharge opening for discharging liquid medium, a feed path for transporting the medium to the discharge opening, and an outlet valve which is designed to open the discharge opening as a function of the pressure in the feed path.

Generic discharge devices and discharge heads for discharge devices are known from the prior art. When appropriate discharge devices are used, a pump device with a variable volume pump chamber or a pump device of a different kind places medium into the flow path, said medium leading, at a sufficiently high pressure, to opening of the outlet valve and therefore to a discharge of the medium out of the feed path into the environment. In this case, the outlet valve opens only at a structurally predetermined limit pressure. This ensures that a desired shape of the discharge, for example a spray discharge, is obtained.

A problem technically with discharge devices and discharge heads of this type is that, in the delivery state of the discharge device and after a prolonged period in which the discharge device is not used, the feed path is filled with air. When the discharge device is put into operation by being actuated, although said air in the feed path is compressed such that the pressure in the feed path or feed path increases, the air pressure which arises does not suffice in order to open the pressure-controlled outlet valve, and therefore an escape of the air can be achieved only with difficulty. This problem occurs to an increased extent if the limit pressure of the outlet valve is particularly high because of the medium used or the discharge characteristic required, for example in the case of dispenser systems for high-viscosity media.

OBJECT AND SOLUTION

It is therefore the object of the invention to develop a generic discharge device and a generic discharge head to the effect that, when the discharge device is put into operation, the air located in the system can be removed in a simple and uncomplicated manner.

According to the invention, this is achieved by a generic discharge device and a generic discharge head which have a gas-permeable and liquid-tight air outlet which connects the pump chamber or the feed path to an external environment.

Such a configuration of a discharge device and of a discharge head permits a separate exit for the air which otherwise, because of its compressibility, opposes a sufficient increase in pressure in order to open the outlet valve. The air which, prior to the generation of a positive pressure, is located in the pump chamber and/or in the feed path to the outlet valve, is therefore output, upon generation of a positive pressure, out of the pump chamber and/or the feed path into an external environment, with the media store also constituting the external environment within the context of this invention. In this case, an exceeding of the limit pressure of the outlet valve is not required. When putting the device into operation, the air in the pump chamber and/or the feed path can be replaced by single or repeated actuation of the pump, by means of liquid until there is a sufficient amount of liquid in the pump chamber and/or the feed path in order, owing to the incompressibility of the liquid, to achieve, upon a further actuation, the limit pressure required for opening the outlet valve. As soon as the air has been completely or virtually completely displaced out of the feed path and the pump chamber, every actuation together with the association reduction in volume leads virtually directly to a liquid pressure being set which is greater than said limit pressure. The operating state is thereby reached.

The pump device is preferably a manually actuated pump device. It conveys medium into the feed path from a media store which is integrated in the discharge device or can be connected to the discharge device. In the simplest case, the feed path itself can be formed by a simple passage between the pump device and discharge opening. However, other designs are also conceivable, in particular those in which an olive-shaped nose in its entirety constitutes the feed path, with medium being conveyed into the olive-shaped nose by the pump device and the discharge opening for discharging the medium being provided at the distal end of the olive-shaped nose. The outlet valve is preferably a spring-loaded outlet valve which closes at a pressure which is less than a limit pressure and thereby prevents medium from being able to emerge inadvertently and also impurities from being able to inadvertently penetrate the discharge device. By means of the limit pressure which is predetermined by the design of the outlet valve and from which the outlet valve opens, it is ensured that a minimum pressure required for correct discharge is achieved before medium emerges. This is required in particular with regard to obtaining desired spray patterns.

The gas-permeable and liquid-tight air outlet can be formed in various ways. In conjunction with this invention, gas-permeability is to be understood in such a manner that the air outlet is gas-permeable if it permits the air to be discharged even at an air pressure within the feed path that lies below the limit value required for opening the outlet valve. It is preferred if the gas permeability of the air outlet in accordance with Gurley is less than or equal to 50 seconds, preferably less than or equal to 30 seconds, particularly preferably less than 20 seconds. In conjunction with this invention, the liquid density of the air outlet is to be understood in such a manner that, up to the limit pressure from which the outlet valve opens, no liquid emerges at the air outlet. If liquid emerging at the air outlet is limited to just moistening of that side of the air outlet which faces away from the pump chamber or the feed path, it is still considered to be liquid-tight within the meaning of the invention.

It is preferred that the air outlet is provided in the region of the feed path, in particular in a region which is at the top in a use position of the discharge device or of the discharge head. The arrangement of the air outlet in the feed path, in particular in an upper region of the feed path, ensures that, when the discharge device is put into operation, the air outlet is not prematurely locked by liquid in the feed path. The remaining air can therefore be discharged through the air outlet even if a substantial part of the feed path is already filled with medium. The air outlet is preferably provided, with reference to a normal use position of the device, approximately level with the discharge opening or above the discharge opening.

It is particularly preferred that the air outlet for the air and the discharge opening for the liquid are designed such that they point in opposite directions and such that they are orthogonal to a main direction of extent of the discharge device. In this case, the main direction of extent is preferably a vertical direction with regard to a customary use position of the discharge device. The design with an air outlet and a discharge opening which point in opposite directions is structurally skillful, since it permits a relatively compact construction, in which the air outlet and the discharge opening do not have to be provided adjacent to each other.

In a development of the invention, the air outlet is provided in a valve slide of the outlet valve, preferably on a side lying opposite a closing section of the valve slide, in particular on a pressure plate of the valve slide, which pressure plate is provided on the opposite side. This permits a very compact construction. The pressure plate of the valve slide extends radially from the preferably pin-shaped shaft of the valve slide. One side of the pressure plate closes off a pressure chamber which belongs to the feed path and is connected thereto. There is ambient pressure on the other side of the pressure plate. Owing to its planar configuration and the fact that, by its nature, it delimits the feed path or feed path in relation to the environment, the pressure plate is particularly readily suitable for the air outlet to be arranged on it. Since the valve slide is generally a separate component, it is also advantageous, in terms of assembly, to provide the air outlet on the valve slide, since separate components of the air outlet, for example a separate membrane, can be more readily inserted into the valve slide instead of into a discharge device housing to which access is difficult.

A discharge device according to the invention or a discharge head according to the invention is particularly preferred, in which the air outlet is closed by a gas-permeable and liquid-tight membrane. A membrane of this type can be accommodated in a highly space-saving manner and, in particular, can be accommodated in the feed path or wall sections delimiting the feed path without the overall size of the discharge device or of the discharge head being negatively affected. The expedient area of the membrane is determined in particular in accordance with the quantity of air to be displaced and the air pressure when the discharge device is actuated. Good experiences have been had with membrane areas from 1 $mm^2$. The required membrane area may also be distributed over a plurality of membranes.

Membranes with an average pore size of between 0.1 μm and 0.5 μm are preferred. Membranes with a pore size which is smaller than 0.2 μm are particularly suitable because of their high degree of tightness against microbiological contaminations. A larger pore size, for example of 0.45 μm, is expedient in particular in the case of those membranes which are protected against contamination by additional measures on their outer side, for example by means of corresponding housing sections which protect the membrane against contacts. Such comparatively large pore sizes are also expedient if the requirements for tightness against microbiological contaminations are less exacting, since smaller and/or fewer membranes can be used, which leads to reduced production costs. In particular in the case of pasty and high-viscosity media, particularly in the case of media from the cosmetic sector, larger pores with an average size of more than 0.4 μm are preferred.

The membrane is preferably formed integrally with a component of the discharge device. In this case, the component and the membrane are preferably composed of the same material, for example a suitable plastic. However, the invention also encompasses embodiments in which different materials for the membrane and the component supporting it are provided. Suitable supporting components are, in particular, a housing or a valve slide of the discharge device or of the discharge head. The integral design ensures a firm seat for the membrane, which, in particular, also withstands the liquid pressure during use.

In a development of the invention, the air outlet is designed to provide a microbiological seal such that impurities cannot pass through the air outlet into the discharge device or the discharge head.

The use of a membrane made of PTFE or polyester, with said membrane preferably having a thickness of less than 500 μm, preferably less than 350 μm is particularly preferred. Owing to rapid venting with good liquid tightness at the same time, such a membrane has proven highly readily suitable for this intended use. Particularly good results have been obtained with membranes having a thickness of between 200 μm and 330 μm.

BRIEF DESCRIPTION OF THE DRAWINGS

Further advantages and features of the invention emerge from the claims and from the description below of two preferred exemplary embodiments of the invention which are illustrated with reference to the drawings, in which:

DETAILED DESCRIPTION OF THE EXEMPLARY EMBODIMENTS

Figure 1:
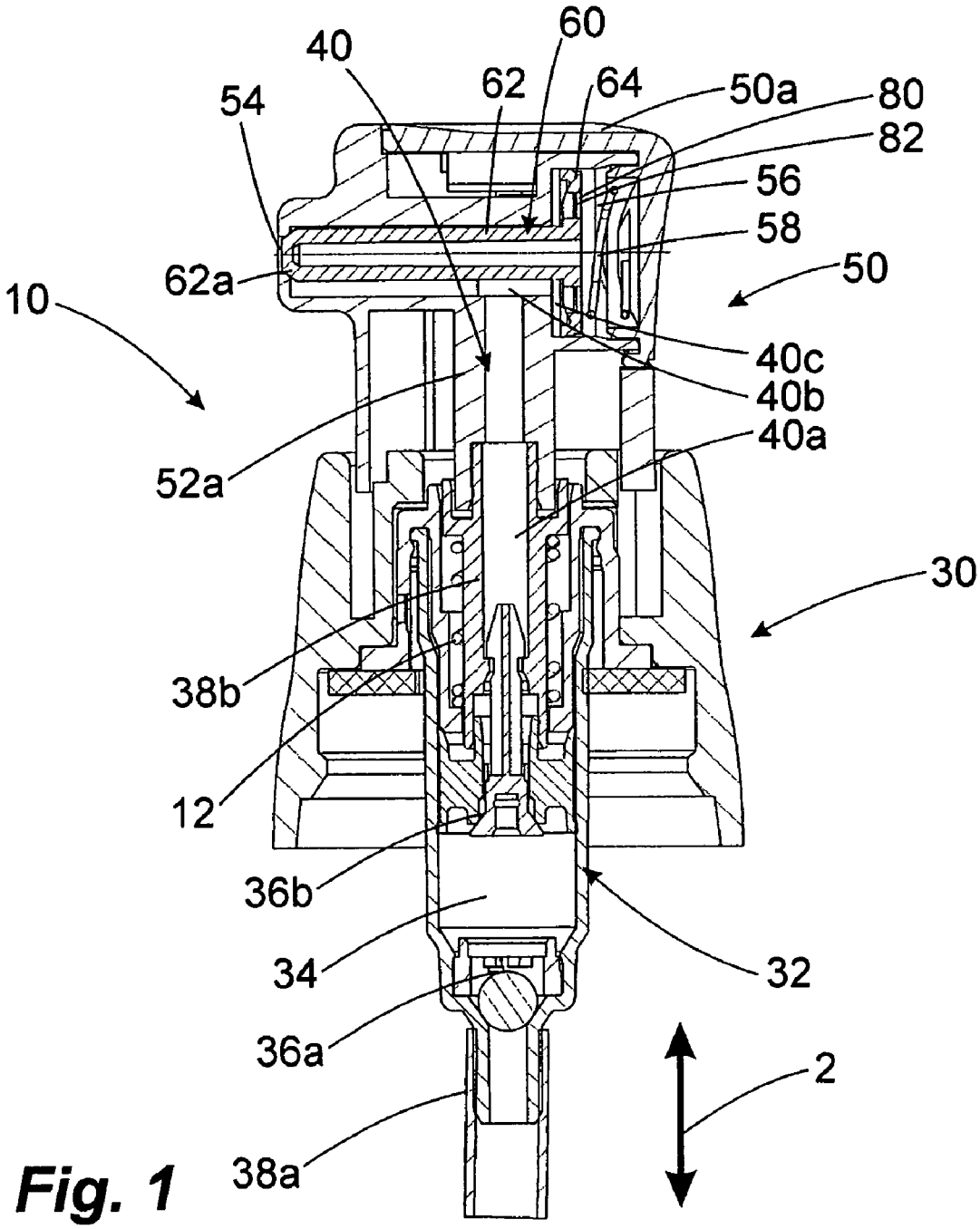
FIG. 1 shows a first embodiment of a discharge device according to the invention with a discharge head according to the invention.

FIG. 1 shows a discharge device 10 with a pump top part 30 and a discharge head 50. The discharge device 10 is provided for fastening to a media store (not illustrated). The pump top part 30 comprises a pump 32. Said pump 32 has a pump chamber 34 which is closed on the input side by an input valve 36*a* and on the output side by an output valve 36*b*. A suction tube 38*a* through which medium can be conveyed from the media store into the pump chamber 34 is provided on the far side of the input valve 36*a*.

The output valve 36*b* is adjoined by a tube section 38*b* which defines a first section 40*a* of a feed path 40. A tube section 52*a* which is on the discharge head side and delimits part of an approximately L-shaped second section 40*b* of the feed path 40 is pressed on to the tube section 38*b*. Said second section 40*b* of the feed path 40 is adjoined by a pressure chamber 40*c* and a discharge opening 54.

The tube section 52*a* is part of the discharge head 50. By means of the connection of the tube section 52*a* to the tube section 38*b*, the discharge head 50 is simultaneously also connected to the pump top part 30.

A valve slide 60 is provided in a part of the second section 40*b* of the feed path 40, which part extends transversely with respect to a main direction of extent 2, and in the pressure chamber 40*c*, said valve slide having a shaft-shaped section 62 and a valve plate 64 radially adjoining the shaft-shaped section 62.

The shaft 62 is arranged within the second section 40*b*. It has a conically shaped end 62*a* which tightly closes the discharge opening 54 in the closed state illustrated. This configuration of the conical end 62*a* and of the discharge opening 54 constitutes reliable protection against microbiological contaminations.

The valve plate 64 is arranged within the pressure chamber 40*c* and separates the latter from an adjacent spring-holding space 56. The outside diameter of the valve plate 64 is matched to the inside diameter of the pressure chamber 40*c* such that liquid cannot pass from the pressure chamber 40*c* into the spring-holding space 56. A spring 58 which is supported on the housing of the discharge head 50, acts upon the valve slide 60 with a spring force in the direction of the discharge opening 54 and thereby produces the closed state is arranged in the spring-holding space.

The operation of the discharge device once it has been put into operation is explained below.

The discharge device is actuated by an actuating stroke, which acts in the main direction of extent 2, brought about counter to the resetting force of the resetting spring 12 by an actuating force applied to a finger rest 50*a* of the discharge head 50. By this means, the discharge head 50 is displaced in its entirety together with the feed path 40 in the direction of the pumping section 30. This leads to a closing of the input valve 36*a* and to an opening of the output valve 36*b*. As a result, the liquid present at this time in the pump chamber 34 is conveyed into the feed path 40 which is likewise already filled with liquid. The incompressibility of the liquid means that this correctly leads directly to a significant increase in pressure in the entire system comprising pump chamber 34 and feed path 40, leading to the valve slide 60 being displaced counter to the spring force of the spring 58. By this means, the discharge opening 54 is opened and the pressurized medium is discharged from the feed path 40 until the liquid pressure in the feed path has dropped again below the limit pressure for opening the outlet valve. After the actuating force is released, a resetting spring 12 brings the pumping section 30 and the discharge head 50 again into the starting position of FIG. 1, with the pump chamber volume being increased again when the output valve 36*b* is closed and the input valve 36*a* is open and, in the process, conveying new medium out of the media store into the pump chamber 34.

For the purpose of putting the discharge device into operation for the first time and for putting it back into operation after a prolonged period of not being used, air outlet openings 80 which are closed by thin-walled membranes 82 are provided in the valve plate 64. In the case of the embodiment of FIG. 1, the membranes 82 are designed as PTFE membranes and are connected integrally to the valve slide 60. The membranes are gas-permeable and, in particular, air-permeable, but form a barrier for liquid. Furthermore, the membranes with an average pore size of approximately 0.2 μm form good protection against the penetration of microbiological dirt. Together with the discharge opening 54 which is designed to likewise provide a microbiological seal in an unused operative state, there is therefore reliable and complete protection against such contaminations.

In the starting state before being put into operation for the first time, the feed path 40 and possibly the pump chamber 34 are filled with air. If an actuation of the discharge device takes place in this state, the volume in the entire system comprising pump chamber 34 and feed path 40 is reduced such that the air pressure in the feed path 40 is increased. The effect achieved by this is that part of the air flows out of the feed path 40 to the outside through the membranes 82. After the actuation, the discharge head is pressed again into its starting position by the resetting spring 12, which, when the output valve 36*b* is closed, results in the volume of the pump chamber being increased and in an associated suction of liquid out of the media store into the pump chamber 34. During said return stroke, there is no negative pressure in the feed path 40 and therefore in the pressure chamber 40*c*, and therefore air is not drawn into the pressure chamber 40*c* from the environment. Upon the next actuating, the liquid is pressed out of the pump chamber 34 into the feed path 40 where it in turn displaces air which escapes through the air outlets 80. By means of repeated actuation, more liquid is conveyed step by step into the feed path 40 and the air is pressed out of the feed path 40 through the membranes 82. If there is a sufficiently large amount of liquid in the feed path 40 and the pressure can no longer be reduced by displacement of air, a sufficiently high pressure is achieved in the feed path over the course of the actuation in order to obtain an opening of the outlet valve by means of a displacement of the valve slide 60. As a result, the operating state of the discharge device is reached, in which every actuation leads to an opening of the outlet valve.

Figure 2:
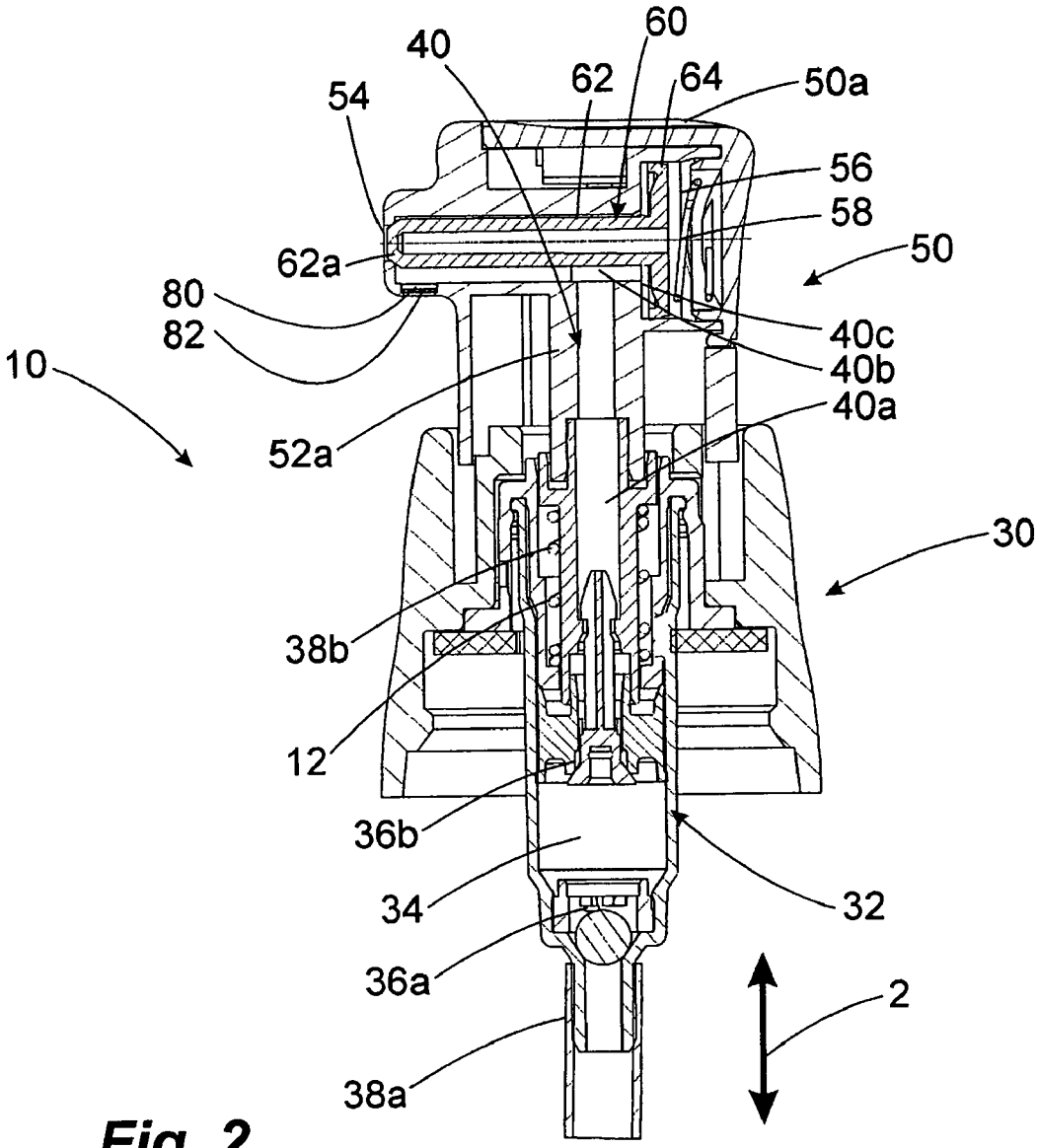
FIG. 2 shows a second embodiment of a discharge device according to the invention with a discharge head according to the invention.

The embodiment of FIG. 2 is largely comparable to the embodiment of FIG. 1. The sole difference is that, in this embodiment, the membrane 82 is provided in the region of the discharge opening 54 rather than on the valve plate 64. Furthermore, in this embodiment, the membrane 82 is merely placed with a slight press fit into a stepped outlet opening 80. A connection, which goes beyond this, of the membrane 82 to the housing of the discharge head is not required, since, during operation, normal pressure or positive pressure always prevails in the feed path, and therefore there need be no concern that the membrane will be sucked into the feed path.

The technical operation of the discharge device of FIG. 2 is otherwise identical to that of FIG. 1.

The invention claimed is:

1. Discharge device for discharging liquid or pasty medium, comprising:

a pump device with a variable volume pump chamber limited by an input valve on an input side and an output valve on an output side, a discharge opening for the liquid medium, a feed path between the output side of the pump device and the discharge opening, an outlet valve which is designed to open the discharge opening as a function of the pressure in the feed path, and a gas-permeable and liquid-tight air outlet which connects the pump chamber or the feed path to an external environment, said air outlet being closed by a gas-permeable and liquid-tight membrane disposed to allow air located in the feed path under positive pressure to escape through said air outlet.

2. Discharge device according to claim 1, wherein the air outlet is disposed in a region of the feed path disposed at the top of the discharge device in a use position of the discharge device.

3. Discharge device according to claim 1, wherein the air outlet for the air and the discharge opening for the liquid extend in opposite directions from one another, the air outlet and the discharge opening being orthogonal to a main direction of extent of the discharge device.

4. Discharge device according to claim 1, wherein the air outlet is disposed at a side of the valve slide lying opposite to a closing section of the valve slide.

5. Discharge device according to claim 1, wherein the membrane has an average pore size of between 0.1 μm and 0.5 μm.

6. Discharge device according to claim 1, wherein the membrane is formed integrally in a component of the discharge device.

7. Discharge device according to claim 1, wherein the air outlet is designed to provide a microbiological seal.

8. Discharge device according to claim 1, wherein the membrane is composed of PTFE or polyester and has a thickness of less than 500 μm.

9. Discharge device according to claim 8, wherein the membrane has a thickness of less than 350 μm.

10. Discharge device according to claim 1, including a suction tube connected to the pump device via the input valve on the input side.

11. Discharge device according to claim 10, wherein the suction tube is arranged to convey a liquid or pasty medium from a media store to the pump chamber.

12. Discharge device according to claim 4, wherein the air outlet is provided adjacent a pressure plate of the valve slide.

13. Discharge head for a discharge device, comprising:

a discharge opening for discharging liquid medium, a feed path for transporting the medium to the discharge opening, an outlet valve which is designed to open the discharge opening as a function of the pressure of the feed path, and a gas-permeable and liquid-tight air outlet which connects the feed path to an external environment, said outlet being closed by a gas-permeable and liquid-tight membrane that allows air located in the feed path under positive pressure to escape through said air outlet.

* * * * *